US012325887B2

(12) United States Patent
Kim et al.

(10) Patent No.: US 12,325,887 B2
(45) Date of Patent: Jun. 10, 2025

(54) BLACK COLOR PLATED STEEL SHEET, AND MANUFACTURING METHOD THEREOF

(71) Applicants: POSCO Co., Ltd, Pohang-si (KR); RESEARCH INSTITUTE OF INDUSTRIAL SCIENCE & TECHNOLOGY, Pohang-si (KR)

(72) Inventors: Hye Jeong Kim, Pohang-si (KR); Kyung Hwang Lee, Incheon (KR); Taek Geun Lee, Pohang-si (KR)

(73) Assignee: POSCO CO., LTD., Pohang-si (KR)

( * ) Notice: Subject to any disclaimer, the term of this patent is extended or adjusted under 35 U.S.C. 154(b) by 0 days.

(21) Appl. No.: 18/268,782

(22) PCT Filed: Dec. 21, 2021

(86) PCT No.: PCT/KR2021/019530
§ 371 (c)(1),
(2) Date: Jul. 21, 2023

(87) PCT Pub. No.: WO2022/139421
PCT Pub. Date: Jun. 30, 2022

(65) Prior Publication Data

US 2024/0294999 A1 Sep. 5, 2024

(30) Foreign Application Priority Data

Dec. 21, 2020 (KR) ..... 10-2020-0179525

(51) Int. Cl.
*C22C 18/04* (2006.01)
*C21D 1/74* (2006.01)

(52) U.S. Cl.
CPC ..... *C21D 1/74* (2013.01); *C22C 18/04* (2013.01)

(58) Field of Classification Search
CPC ..... B32B 15/013; C22C 18/04
(Continued)

(56) References Cited

U.S. PATENT DOCUMENTS

| | | | | |
|---|---|---|---|---|
| 4,029,478 | A | 6/1977 | Lee | |
| 4,610,937 | A | 9/1986 | Ito et al. | |
| 2015/0072166 | A1* | 3/2015 | Nakano | C23C 8/00 428/629 |

FOREIGN PATENT DOCUMENTS

| | | | |
|---|---|---|---|
| EP | 2843081 | A1 | 3/2015 |
| EP | 2843082 | A1 | 3/2015 |

(Continued)

OTHER PUBLICATIONS

International Search Report dated Mar. 25, 2022, issued in International Patent Application No. PCT/KR2021/019530 (with English translation).

(Continued)

*Primary Examiner* — Katherine A Christy
(74) *Attorney, Agent, or Firm* — Morgan Lewis & Bockius LLP

(57) ABSTRACT

A black plated steel sheet may include a steel sheet and a zinc plating layer positioned on one side of the steel sheet. The zinc plating layer may contain a black layer on the uppermost surface. The black layer may include three or more portions of which the blackness is different from each other. In a first part, the thickness of the black layer may be more than 1 μm. In a second part, the thickness of the black layer may be 250 nm or more to less than 1 μm, and in a third part, the thickness of the black layer may be less than 200 nm.

5 Claims, 5 Drawing Sheets

(58) Field of Classification Search
USPC ..... 428/632
See application file for complete search history.

(56) References Cited

FOREIGN PATENT DOCUMENTS

| | | | |
|---|---|---|---|
| EP | 2857544 | A1 | 4/2015 |
| JP | H06-316772 | A | 11/1994 |
| JP | 2000-096262 | A | 4/2000 |
| JP | 2000-178705 | A | 6/2000 |
| JP | 2001-115273 | A | 4/2001 |
| JP | 2002-226958 | A | 8/2002 |
| JP | 2004-360056 | A | 12/2004 |
| JP | 2010-070809 | A | 4/2010 |
| JP | 2012-214896 | A | 11/2012 |
| JP | 2013-227622 | A | 11/2013 |
| JP | 2013-241665 | A | 12/2013 |
| JP | 2013-241672 | A | 12/2013 |
| KR | 10-1999-0082512 | A | 11/1999 |
| KR | 10-2002-0020113 | A | 3/2002 |
| KR | 10-2014-0128464 | A | 11/2014 |
| KR | 10-2015-0002668 | A | 1/2015 |
| KR | 10-2018-0072273 | A | 6/2018 |
| KR | 10-2019-0104545 | A | 9/2019 |

OTHER PUBLICATIONS

Extended European Search Report dated Aug. 4, 2023 issued in European Patent Application No. 21911488.1.

* cited by examiner

【FIG. 1】
| Before blacken | After blacken |
| --- | --- |
| 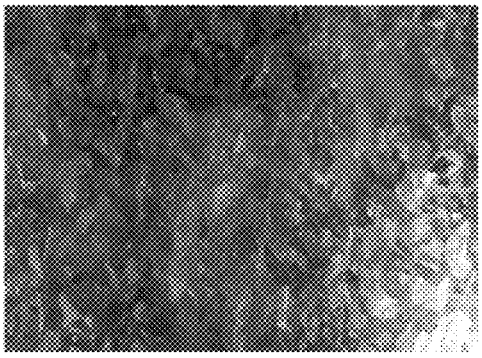 | 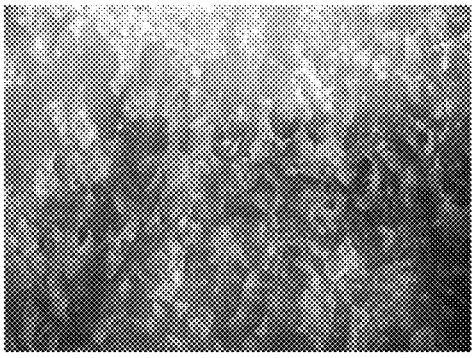 |

【FIG. 2】
| Category | After blacken (AC(150:95:Time)) | | |
|---|---|---|---|
| | Photo | color-difference meter | |
| Regular Spangle (Before blacken) | 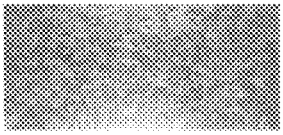 | L* | 85.42 |
| | | a | -2.32 |
| | | b | 2.14 |
| Regular Spangle (1hr, blacken) | 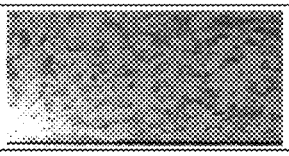 | L* | 59.20 |
| | | a | -1.68 |
| | | b | 2.42 |
| Regular Spangle (2hr, blacken) | 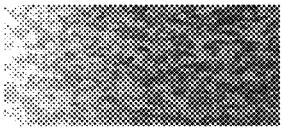 | L* | 57.52 |
| | | a | -2.38 |
| | | b | -1.19 |
| Regular Spangle (5hr, blacken) | 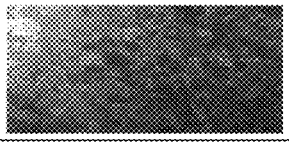 | L* | 42.65 |
| | | a | -0.86 |
| | | b | -2.22 |
| Regular Spangle (10hr, blacken) | 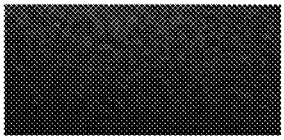 | L* | 32.79 |
| | | a | 0.30 |
| | | b | 0.95 |

【FIG. 3】
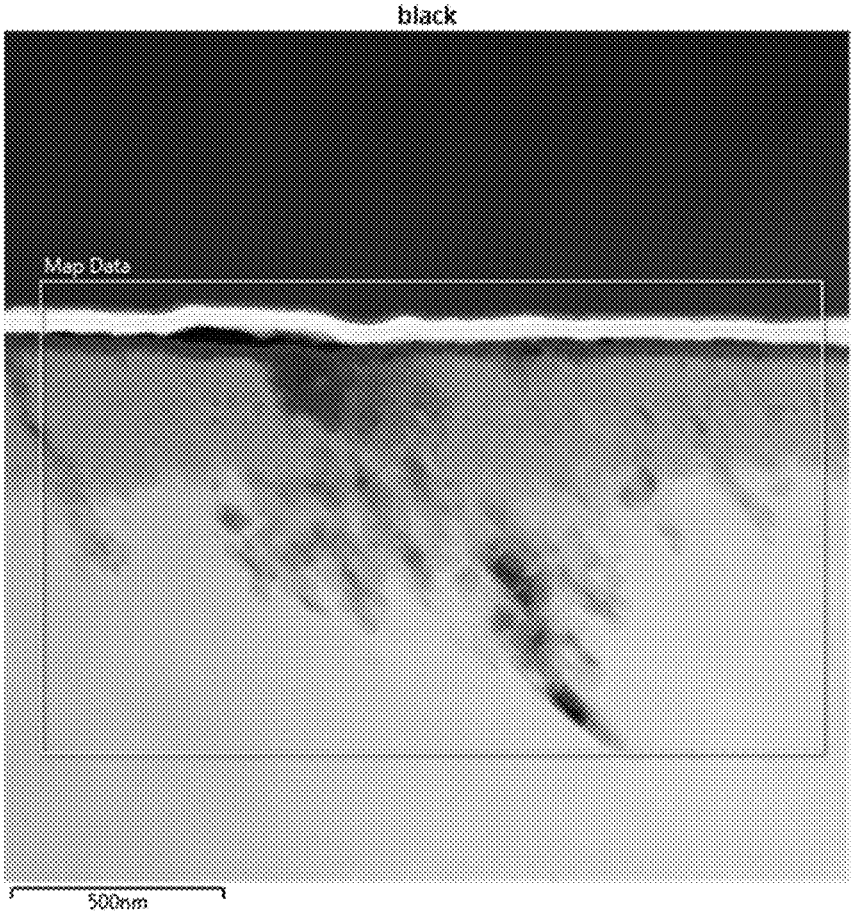
【FIG. 4】
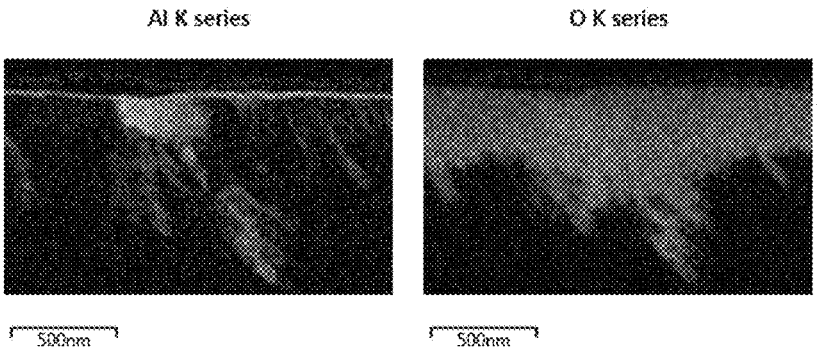

【FIG. 5】
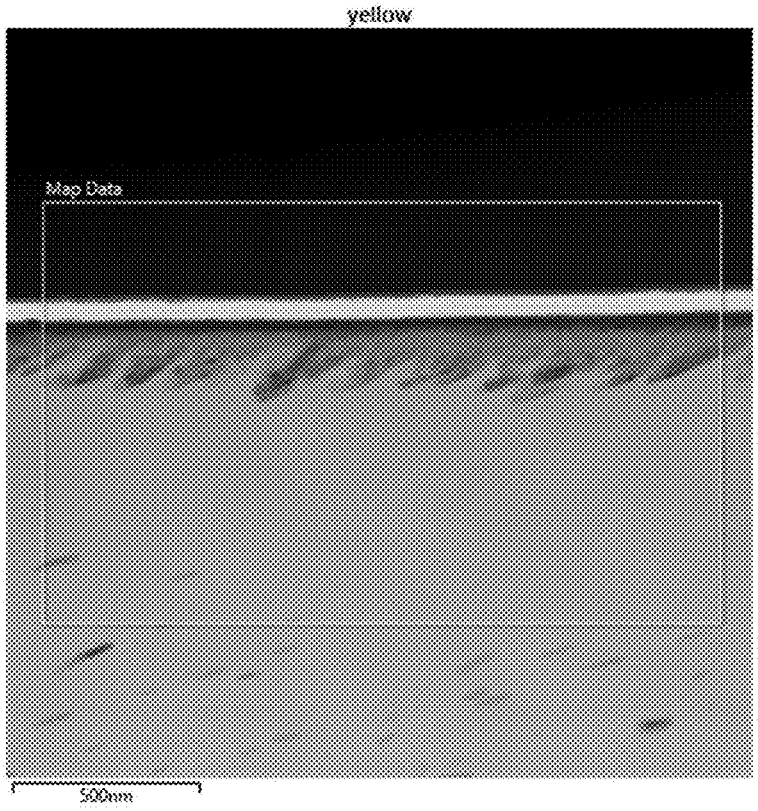
【FIG. 6】
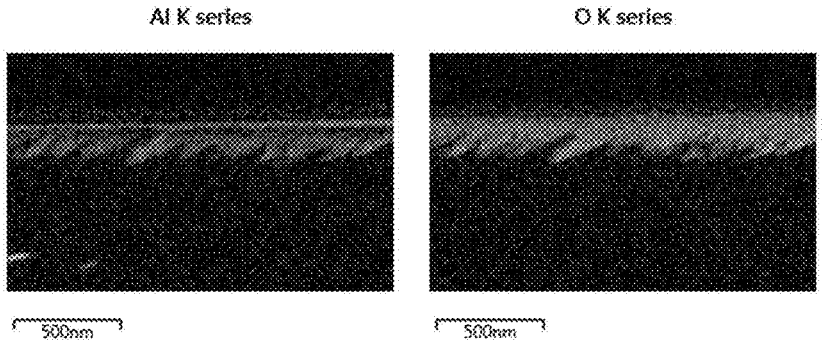

【FIG. 7】
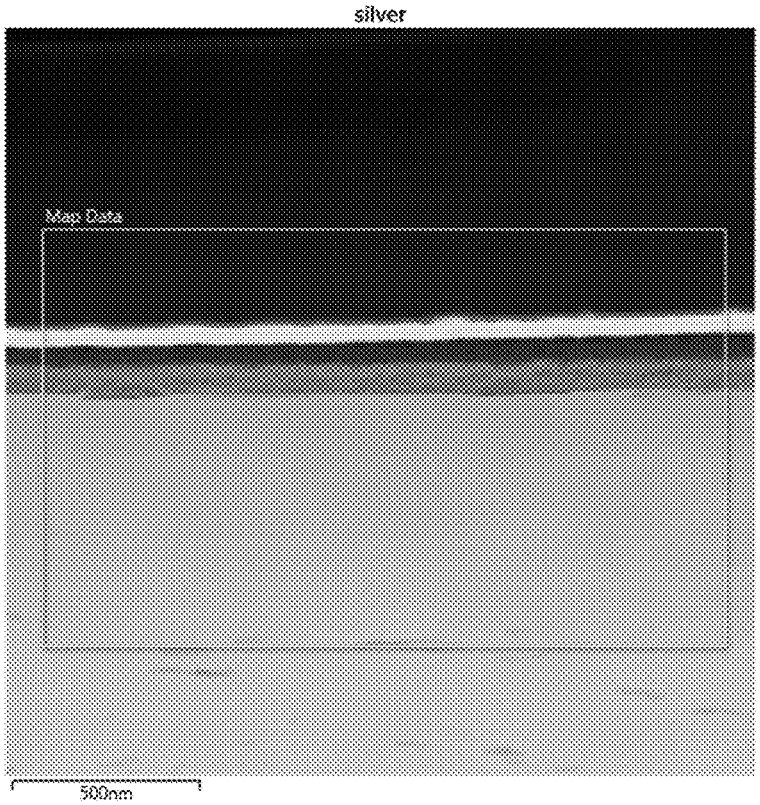
【FIG. 8】
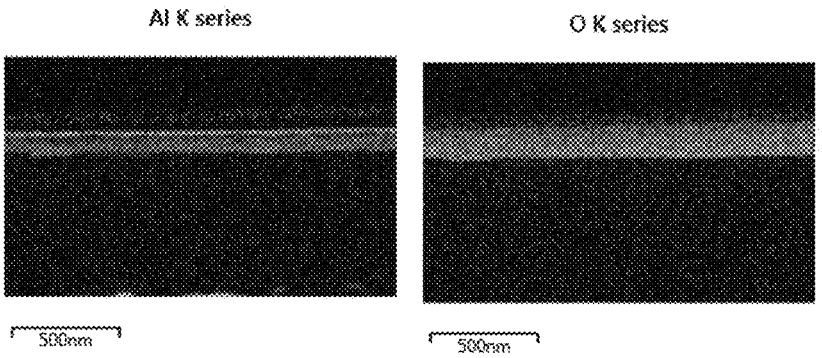

BLACK COLOR PLATED STEEL SHEET, AND MANUFACTURING METHOD THEREOF

CROSS-REFERENCE OF RELATED APPLICATIONS

This application is the U.S. National Phase under 35 U.S.C. § 371 of International Patent Application No. PCT/KR2021/019530, filed on Dec. 21, 2021, which in turn claims the benefit of Korean Application No. 10-2020-0179525, filed on Dec. 21, 2020, the disclosures of which applications are incorporated by reference herein.

FIELD OF THE INVENTION

It relates to a black plated steel sheet and a manufacturing method thereof. Specifically, the present disclosure relates to a black plated steel sheet having a marble texture by controlling the blackness of the steel sheet for each part and a manufacturing method thereof.

DESCRIPTION OF THE RELATED ART

In the fields such as roofing materials and exterior materials for buildings, home appliances, and automobiles, there is an increasing need for steel sheet having a black appearance from the viewpoint of design. Examples of a method of blackening the surface of a steel sheet include a method of forming a black coating film by applying a black paint to the surface of the steel sheet. However, in the above fields, plated steel sheets plated with Zn plating, or Al-containing Zn plating, Al and Mg-containing Zn plating, Si-containing Al plating, and Mg and Si-containing Al plating, and the like are often used from the viewpoint of corrosion resistance, and the surface of such a plated steel sheet has a silvery white hue with a metallic luster. Therefore, in order to obtain a highly designed black appearance by applying a black paint, the coating film needs to be thickened to hide the base color, thereby increasing the painting cost.

As a method of shielding the metallic luster and silvery white hue of the plated steel sheet without forming a black coating film, a method of blackening the plating layer itself has been proposed. As an example, a method of forming a thin black film on the surface layer of the plating layer by spraying high-temperature aqueous vapor on a molten Al-containing Zn-plated steel sheet for 24 hours or more is disclosed. As another example, a method of blackening the plating layer by using Zn plating steel containing molten Al and Mg to blacken the surface of an alloy plated steel sheet and contacting the molten plated steel sheet with aqueous vapor in a close and seal container is proposed.

The present disclosure intends to provide a black plated steel sheet whose surface is partially blackened using a low-cost zinc plated steel sheet with controlled spangles to show a beautiful marble texture.

SUMMARY OF THE INVENTION

One embodiment of the present disclosure provides a black plated steel sheet and its manufacturing method. Specifically, the present disclosure aims to provide a black plated steel sheet showing a marble texture by blackening the plated steel sheet on which the spangles are formed and adjusting the blackness for each part.

The present disclosure can provide a black plated steel sheet, comprising:

a steel sheet and a zinc plating layer positioned on one side of the steel sheet, wherein, the zinc plating layer contains a black layer on the uppermost surface, the black layer includes three or more portions of which the blackness is different from each other, in a first part, the thickness of the black layer is more than 1 μm, in a second part, the thickness of the black layer is 250 nm or more to less than 1 μm, in a third part, the thickness of the black layer is less than 200 nm.

The black layer contains an oxide or hydroxide of Zn, Pb, Sb or Al.

The zinc plating layer comprises Al: 0.18 to 0.22 wt %, Pb: 0.06 to 0.2 wt %, Sb: 0.06 to 0.08 wt % and balance Zn.

In two or more spangle patterns having different blackness of the black layer, the lightness L* deviation of each spangle pattern is 5 to 40.

The black layer has an average lightness L* of 60 or less.

An inorganic film or organic film positioned on the zinc plating layer is further comprised.

Another present disclosure can provide a manufacturing method of black plated steel sheet, comprising:

a step of charging a plating steel sheet, including a zinc plating layer, into a close and seal container; and a step of a constant-humidity heat treatment by injecting aqueous vapor into a close and seal container into which the plating steel plate is charged, and heat treating the plating steel plate;

wherein, after the constant-humidity heat treatment step, the zinc plating layer contains a black layer on the uppermost surface, the black layer includes three or more portions of which the blackness is different from each other, in a first part, the thickness of the black layer is more than 1 μm, in a second part, the thickness of the black layer is 250 nm or more to less than 1 μm, in a third part, the thickness of the black layer is less than 200 nm.

The zinc plating layer comprises Al: 0.18 to 0.22 wt %, Pb: 0.06 to 0.2 wt %, Sb: 0.06 to 0.08 wt % and balance Zn.

In the constant-humidity heat treatment step, an oxygen concentration in the close and seal container is less than 13 volume %.

In the constant-humidity heat treatment step, the heat treatment time is 1 hour to 10 hours.

In the constant humidity heat treatment step, the close and seal container is maintained at a humidity of 50 to 100 RH %.

In the constant humidity heat treatment step, the heat treatment temperature is 100 to 200° C.

In the constant humidity heat treatment step, the zinc plating layer is oxidized to a different degree of blackening according to the spangle pattern.

A step of forming an inorganic film or organic film on the blackened surface is included after the constant humidity heat treatment step.

According to one embodiment of the present disclosure, a black plated steel sheet having a marble texture pattern may be manufactured using a zinc plated steel sheet in which spangles are formed.

BRIEF DESCRIPTION OF THE DRAWINGS

FIG. 1 shows the surface of the steel sheet before and after blackening in one embodiment of the present disclosure.

FIG. 2 shows the steel sheet surface image and color difference according to the blackening time in one embodiment of the present disclosure.

FIG. 3 shows a cross-section of the black color part of the blackened steel sheet manufactured in Example 2.

FIG. 4 shows an element distribution of Al (left) and an element distribution of O (right) in the black color part of the blackened steel sheet manufactured in Example 2.

FIG. 5 shows a cross-section of the yellow part of the blackened steel sheet manufactured in Example 2.

FIG. 6 shows an element distribution of Al (left) and an element distribution of O (right) in the yellow part of the blackened steel sheet manufactured in Example 2.

FIG. 7 shows a cross-section of the silver part of the blackened steel sheet manufactured in Example 2.

FIG. 8 shows an element distribution of Al (left) and an element distribution of O (right) in the silver part of the blackened steel sheet manufactured in Example 2.

DETAILED DESCRIPTION OF THE EMBODIMENTS

The terms such as first, second, and third are used to describe various portions, components, regions, layers, and/or sections, but various parts, components, regions, layers, and/or sections are not limited to these terms. These terms are only used to distinguish one part, component, region, layer, or section from another part, component, region, layer, or section. Accordingly, a first part, component, region, layer, or section described below may be referred to as a second part, component, region, layer, or section without departing from the scope of the present invention.

Terminologies as used herein are to mention only a specific exemplary embodiment, and are not to limit the present invention. Singular forms used herein include plural forms as long as phrases do not clearly indicate an opposite meaning. The term "including/comprising" as used herein concretely indicates specific characteristics, regions, integer numbers, steps, operations, elements, and/or components, and is not to exclude presence or addition of other specific characteristics, regions, integer numbers, steps, operations, elements, and/or components.

When any portion is referred to as being "above" or "on" another portion, any portion may be directly above or on another portion or be above or on another portion with the other portion interposed therebetween. In contrast, when any portion is referred to as being "directly on" another portion, the other portion is not interposed between any portion and another portion.

In addition, unless otherwise noted, % means wt %, and 1 ppm is 0.0001 wt %.

In an exemplary embodiment of the present invention, the meaning further comprising an additional element in the component means that the element that is the balance is included by replacing the amount of additional element added.

Unless defined otherwise, all terms including technical terms and scientific terms as used herein have the same meaning as the meaning generally understood by a person of an ordinary skill in the art to which the present invention pertains. Terms defined in a generally used dictionary are additionally interpreted as having the meaning matched to the related art document and the currently disclosed contents and are not interpreted as ideal or formal meaning unless defined.

Hereinafter, an exemplary embodiment will be described in detail so that a person of an ordinary skill can easily practice it in the technical field to which the present invention belongs. As those skilled in the art would realize, the described embodiments may be modified in various different ways, all without departing from the spirit or scope of the present invention.

Hereinafter, each step is examined in detail.

A black plated steel sheet of one embodiment includes a steel plate and a zinc plating layer positioned on one surface of the steel plate, the zinc plating layer includes a black layer on the uppermost surface, and the black layer includes two or more spangle patterns having different blackness.

The spangle pattern of the molten zinc plating steel sheet appears from large crystal structures ranging in size from hundreds of μm to thousands of μm. This is because the solidification of molten zinc starts between the plating layer and the base iron interface and grows to the surface layer of the plating layer, and the orientation of the (0001) plane changes to a crystal unit, causing a difference in glossiness of molten zinc plating to form a spangle pattern. In addition, when the molten zinc plating layer contains at least one selected from Pb, Sb, and Al, the size of the spangles can be crystallized according to the included amount. Accordingly, the spangle patterns formed on the surface of the zinc plating steel sheet are patterns produced by different orientations, and each has a different degree of blackening, so that patterns can be formed on the black plated steel sheet.

The black layer includes three or more parts with different blackness, a first part (black color) has a thickness of 1 μm or more of the black layer, a second part (yellow color) has a thickness of 250 nm or more to less than 1 μm, and a third In the part (silver), the thickness of the black layer may be 200 nm or less. More specifically, the first part may have a black layer thickness of 1 μm to 3 μm, the second part may have a black layer thickness of 250 nm to 500 nm, and the third part may have a black layer thickness of 100 to 200 nm.

The thickness of the black layer means the deepest depth at which Al, Pb, or Sb oxide appears from the surface to the thickness direction.

Specifically, the zinc plating layer of the black plated steel sheet may include Al: 0.18 to 0.22 wt %, Pb: 0.06 to 0.2 wt %, Sb: 0.06 to 0.08 wt % and balance Zn.

The black layer of the black plated steel sheet may contain oxides or hydroxide of Zn, Pb, Sb or Al.

In the black plated steel sheet, the lightness L* deviation of each spangle pattern may be 5 to 40 in two or more spangle patterns having different blackness of the black layer. That is, depending on the orientation of the zinc plating layer forming the spangle pattern, different blackening results can be displayed even under the same blackening condition. Accordingly, the black plated steel sheet can have a beautiful marble texture surface.

The average lightness L* of the black layer of the black plated steel sheet may be 60 or less. More specifically, the brightness may be 40 or less. More specifically, the brightness may be 30 or less.

Hereinafter, in this specification, the lightness L* value means the lightness value of a color difference meter measured by the ASTM E 1164 method using a spectrophotometer. The lower the lightness L* value, the higher the degree of blackness. More specifically, in the case of black, the lightness L* value is expressed as 0, and in the case of white, the L* value is expressed as 100.

The black plated steel sheet may further include an inorganic film or organic film positioned on the zinc plated layer. The inorganic film may include one or more of oxides, oxysalts, hydroxides, phosphates, and fluorides of one or more of Ti, Zr, Hf, V, Nb, Ta, W, Si, and Al. The organic film may include a urethane resin obtained by reacting a polyol consisting of an ether-based polyol and an ester-based polyol with a polyisocyanate. The proportion of the ether-based polyol in the polyol may be 5 to 30 mass %. By further forming an inorganic film or an organic film, the plating layer may be protected from external impacts and workability during the processing of a product may be improved, and the aesthetic feeling may be enhanced by imparting a translucent color to the inorganic film or the organic film, if necessary.

A manufacturing method of the black plated steel sheet of one embodiment includes:

a step of charging a plating steel sheet, including a zinc plating layer, to a close and seal container; and a constant humidity heat treatment step of injecting aqueous vapor into a close and seal container into which the plating steel plate is charged and heat treating the plating steel plate. Also, in the plating steel sheet, the zinc plating layer may include a spangle pattern.

The zinc plating layer may include Al: 0.18 to 0.22 wt %, Pb: 0.06 to 0.2 wt %, Sb: 0.06 to 0.08 wt % and balance Zn.

In the constant humidity heat treatment step, the oxygen concentration in the close and seal container may be less than 13%. More specifically, the oxygen concentration in the close and seal container may be greater than 0 to less than 13%. In the constant humidity heat treatment step, if the oxygen concentration in the close and seal container is too high, the rate of blackening can be reduced.

In the constant humidity heat treatment step, the heat treatment time may be 1 hour to 10 hours.

In the constant humidity heat treatment step, the close and seal container can be maintained at a relative humidity of 50 to 100 RH %. Specifically, the close and seal container can be maintained at a humidity of 65 to 100 RH %. More specifically, the close and seal container can be maintained at a humidity of 85 to 100 RH %. More specifically, the close and seal container may be maintained at a humidity of 90 to 100 RH %. In the constant humidity heat treatment step, if the humidity in the close and seal container is insufficient, the desired average brightness value (L* 60 or less) may not be achieved due to insufficient blackening.

In the constant humidity heat treatment step, the heat treatment temperature may be 100 to 200° C. Specifically, the heat treatment temperature may be 120 to 180° C. More specifically, the heat treatment temperature may be 140 to 160° C. In addition, if the heat treatment temperature is too low in the constant humidity heat treatment step, the reaction may not occur, and if it is too high, the reaction may be too excessive and the plating layer may be cracked.

In the constant humidity heat treatment step, the zinc plating layer may be oxidized differently according to the spangle pattern. That is, depending on the orientation of the zinc plating layer forming the spangle pattern, different blackening results can be displayed even under the same blackening condition. Accordingly, the black plated steel sheet can have a beautiful marble texture surface.

After the constant humidity heat treatment step, a step of forming an inorganic film or an organic film on the blackened surface may be further included. The film that can be additionally formed is the same as described in the black plated steel sheet.

Hereinafter, an exemplary embodiment will be described in detail so that a person of an ordinary skill can easily practice it in the technical field to which the present invention belongs. However, the present invention can be implemented in many different forms, and is not limited to the example described above.

Experimental Example

A molten zinc plating steel sheet with a spangle pattern was prepared. The zinc plating steel sheet was loaded into a close and seal container, and the plating steel sheet was positioned inside the close and seal container where the internal gas atmosphere was composed. Heat treatment was performed at a temperature of 150° C. while controlling the close and seal container to maintain a constant humidity of 95 RH % in a closed and sealed state. The oxygen concentration inside the close and seal container was set to 13 volume % or less. The blackening heat treatment time was varied as 1 hour, 2 hours, 5 hours, and 10 hours.

According to the constant-humidity heat treatment, the plating layer of the plating steel sheet was oxidized, and the surface was converted into a blackened film with different degrees of blackness according to the spangle pattern.

FIG. 1 shows before and after the blackened steel sheet at 95% of humidity, and 150° C. for 1 hour. FIG. 2 shows the surface photograph of the steel plate and its color difference with different blackening heat treatment times of 1 hour, 2 hours, 5 hours, and 10 hours under the same condition. The average lightness (L*) of the black plated steel sheet according to this Experimental Example was less than 60.

As a result, it was confirmed that the surface was blackened to have a beautiful marble pattern by controlling the blackening time in the case of blackening the zinc plating steel sheet having a spangle pattern.

TABLE 1

| | blackening time | average color difference meter (L*) |
|---|---|---|
| Comparative Example | before blackening | 85.42 |
| Example 1 | blacken 1 hour | 59.20 |
| Example 2 | blacken 2 hour | 57.52 |
| Example 3 | blacken 5 hour | 42.65 |
| Example 4 | blacken 10 hour | 32.79 |

In FIG. 3 to FIG. 8, the cross-section and an element of Al and an element of O distribution in the black, yellow, and silver parts of the steel sheet manufactured in Example 2 were summarized. As can be seen in FIG. 3 to FIG. 8, the black part was formed with a black layer thickness of about 1 μm, the yellow part was formed with about 300 nm, and the silver part was formed with about 200 nm or less.

The present invention is not limited to the exemplary embodiment, but can be manufactured in a variety of different forms, and a person of an ordinary skill in the technical field to which the present invention belongs is different without changing the technical idea or essential features of the present invention. It will be appreciated that it may be embodied in specific forms. Therefore, the exemplary embodiment described above should be understood as illustrative in all respects and not limiting.

What is claimed is:

1. A black plated steel sheet, comprising:

a steel sheet and a zinc plating layer positioned on one side of the steel sheet, wherein, the zinc plating layer contains a black layer on the uppermost surface, the black layer includes three or more portions of which the blackness is different from each other;

in a first part, the thickness of the black layer is more than 1 μm, in a second part, the thickness of the black layer is 250 nm or more to less than 1 μm, in a third part, the thickness of the black layer is less than 200 nm, and the zinc plating layer comprises Al: 0.18 to 0.22 wt %, Pb: 0.06 to 0.2 wt %, Sb: 0.06 to 0.08 wt % and balance Zn.

2. The black plated steel sheet of claim 1, wherein:

the black layer contains an oxide or hydroxide of Zn, Pb, Sb or Al.

3. The black plated steel sheet of claim 1, wherein:

in two or more spangle patterns having different blackness of the black layer, the lightness L* deviation of each spangle pattern is 5 to 40, and the lightness L* is measured according to ASTM E 1164 method.

4. The black plated steel sheet of claim 1, wherein:

the black layer has an average lightness L* of 60 or less, and the lightness L* is measured according to ASTM E 1164 method.

5. The black plated steel sheet of claim 1, further comprising an inorganic film or organic film positioned on the zinc plating layer.

* * * * *